US007677155B2

(12) United States Patent
Marriott et al.

(10) Patent No.: US 7,677,155 B2
(45) Date of Patent: Mar. 16, 2010

(54) STATICALLY SEALED HIGH PRESSURE FUEL PUMP AND METHOD

(75) Inventors: Craig D. Marriott, Clawson, MI (US); Karl J. Kreder, III, Coralville, IA (US)

(73) Assignee: GM Global Technology Operations, Inc., Detroit, MI (US)

( * ) Notice: Subject to any disclaimer, the term of this patent is extended or adjusted under 35 U.S.C. 154(b) by 1099 days.

(21) Appl. No.: 11/331,798

(22) Filed: Jan. 13, 2006

(65) Prior Publication Data

US 2007/0166174 A1 Jul. 19, 2007

(51) Int. Cl.
*F01B 31/00* (2006.01)
*F04B 17/00* (2006.01)

(52) U.S. Cl. ..... 92/86; 417/379; 417/395; 417/415; 417/440

(58) Field of Classification Search ..... 417/357, 417/379, 395, 413.1, 415, 440, 465; 92/86
See application file for complete search history.

(56) References Cited

U.S. PATENT DOCUMENTS 1,787,700 A * 1/1931 Persons ..... 417/439
2,791,372 A 5/1957 Abbatiello
3,584,331 A * 6/1971 D'Hooge ..... 16/82
4,463,663 A * 8/1984 Hanson et al. ..... 92/80
6,062,831 A * 5/2000 Konishi et al. ..... 417/540
6,071,089 A * 6/2000 Maier et al. ..... 417/386
6,142,060 A * 11/2000 Saito et al. ..... 92/71

FOREIGN PATENT DOCUMENTS

| | | |
|---|---|---|
| CN | 1038499 | 1/1990 |
| CN | 1064527 | 9/1992 |
| CN | 2146581 | 11/1993 |
| CN | 1621677 | 6/2005 |
| EP | 255993 A2 | 2/1988 |

* cited by examiner

*Primary Examiner*—Devon C Kramer
*Assistant Examiner*—Leonard J Weinstein
(74) *Attorney, Agent, or Firm*—Quinn Law Group, PLLC.

(57) ABSTRACT

The invention relates to an apparatus and method of statically sealing a reciprocating-type fuel pump, such as a direct injection high pressure piston-type fuel pump. The first embodiment of the invention is a fuel pump comprising a pump body, a fuel reservoir within the pump body, wherein the fuel reservoir is capable of holding fuel and a bellows attached to the pump body, wherein the bellows is a stretchable membrane acting as a static seal. The second embodiment further comprises a diaphragm seal inside the pump body, and adjacent to the fuel reservoir, and a working fluid reservoir adjacent to the diaphragm seal, wherein the working fluid reservoir is capable of holding fluid. The diaphragm seal is a static seal separating the working fluid reservoir and the fuel reservoir.

14 Claims, 1 Drawing Sheet

STATICALLY SEALED HIGH PRESSURE FUEL PUMP AND METHOD

TECHNICAL FIELD

This invention relates to an apparatus and method of statically sealing a reciprocating-type fuel pump, such as a direct injection high pressure piston-type fuel pump.

BACKGROUND OF THE INVENTION

A fuel pump is a device used to draw fuel from a fuel tank and deliver the fuel to the other components of the fuel system of a vehicle. The fuel must be prevented from leaking into the engine. Conventional direct injection high pressure fuel pumps use some form of dynamic seals when isolating the fuel from the engine. The risk of failure modes with this seal may be reduced by using a static seal.

SUMMARY OF THE INVENTION

This invention relates to an apparatus and method of statically sealing a reciprocating-type fuel pump, such as a direct injection high pressure piston-type fuel pump. The invention is for an engine-driven or mechanical fuel pump.

The first embodiment of the invention is a fuel pump comprising a pump body, a fuel reservoir within the pump body, wherein the fuel reservoir is capable of holding fuel, and having a bellows attached to the pump body, wherein the bellows is a stretchable membrane sufficiently in a sealing relationship with the pump body to act as a static seal.

In another aspect of the invention, the fuel pump further comprises a movable piston adjacent to the bellows and translatable within the pump body, wherein the piston is in contact with the fuel reservoir and transmits work to fuel within the fuel reservoir. The bellows is sufficiently in a sealing relationship with the piston to act as a static seal.

The second embodiment further includes a diaphragm seal, inside the pump body and adjacent to the fuel reservoir, and a working fluid reservoir adjacent to the diaphragm seal, wherein the working fluid reservoir is capable of holding a working fluid which need not be engine oil. The diaphragm seal is a static seal separating the working fluid reservoir from the fuel reservoir. The piston is in contact with the working fluid reservoir and transmits work to the working fluid within the working fluid reservoir. The working fluid within the working fluid reservoir, in turn, transmits work to the diaphragm seal. The diaphragm seal, in turn, transmits work to the fuel in the fuel reservoir.

This invention utilizes static seals such that the fuel pump is completely self contained and the working fluid is independent from the engine. The seal is maintained during the motion of the reciprocating structure, which is the piston in the preferred embodiment. This creates advantages over conventional pump designs. The present invention is easily integrated into existing architecture, does not need engine oil and can utilize an ideal working fluid.

The above features and other features and advantages of the present invention are readily apparent from the following detailed description of the best modes for carrying out the invention when taken in connection with the accompanying drawings.

DESCRIPTION OF THE PREFERRED EMBODIMENTS

The invention relates to the static sealing of a reciprocating type fuel pump. In the preferred embodiments, a direct injection high pressure piston-type fuel pump is described. The invention may be applied to other suitable types of fuel pumps.

First Embodiment

Figure 1:
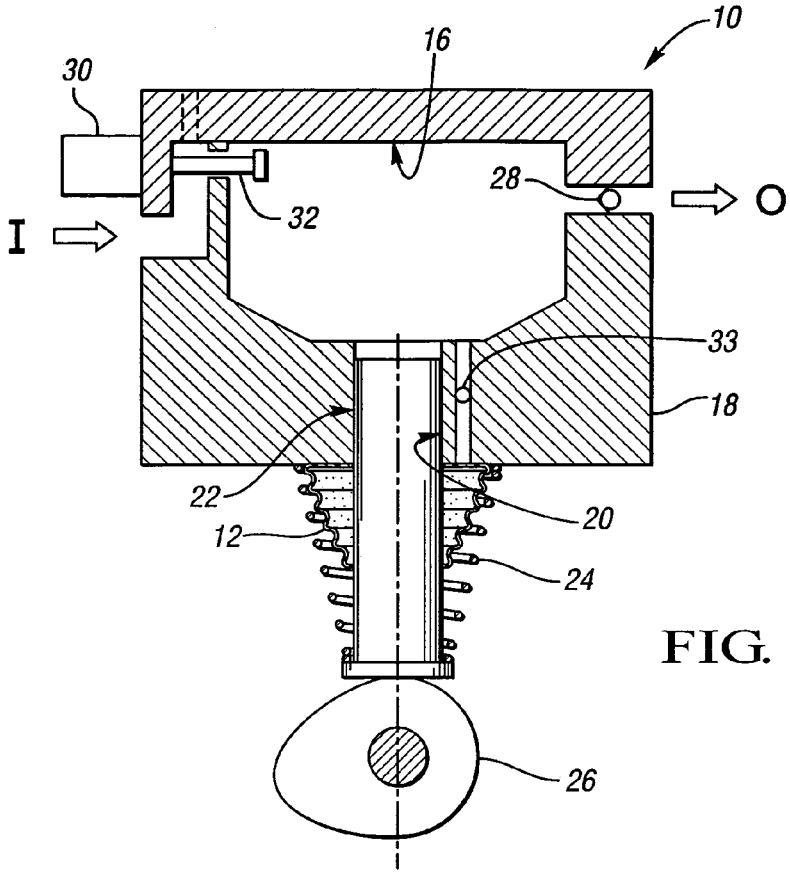
FIG. 1 is a schematic cross sectional view of a statically sealed piston-type high pressure fuel pump, illustrating the first embodiment of the invention.

Referring to FIG. 1, a cross-sectional view of a piston-type high pressure statically sealed fuel pump 10 is illustrated. In the first embodiment of the invention, the statically sealed fuel pump 10 comprises a bellows 12, a fuel reservoir 16 and a pump body 18. The statically-sealed fuel pump 10 further comprises a reciprocating-type structure such as a movable piston 22. The piston 22 is adjacent to the bellows and translatable within the pump body 18.

The bellows 12 is a stretchable membrane that acts as a static seal. Static seals have a longer life and are more durable then dynamic seals. The bellows 12 is physically attached to the pump body 18 and surrounds and embraces the piston 22. It may be attached to the pump body 18 with a static seal, or in the case of a metal bellows, welded to the pump body 18. The bellows 12 may be constructed of an elastomer, stainless steel, rubber or other suitable materials that have sufficient elasticity to distend and contract. The bellows 12 may be corrugated to provide compliance in the material. The bellows 12 is statically sealed to the pump body 18 and the piston 22.

The fuel reservoir 16 is contained within the pump body 18 and may contain gasoline or other suitable fuel. The fuel reservoir 16 comprises a volume in the pump body 18. The fuel reservoir 16 may have many different configurations within the scope of the invention. The piston 22 is positioned in a bore 20, which is a hollow cylindrical structure. A spring 24 surrounds the piston 22.

The piston 22 is reciprocatable or movable due to either direct or indirect contact with a cam lobe 26. The cam lobe 26 applies force on the piston 22, either directly or indirectly. The cam lobe 26 may be in direct contact with a roller lifter follower or a tappet follower (not shown), which in turn transmits force to the piston. The followers are devices that allow the cam lobe 26 to interact with the piston more easily; they reduce friction and are able to withstand the stress of interacting with the cam lobe 26. The spring 24 biasingly ensures there is sufficient contact pressure between the piston 22 and cam lobe 26 for the piston to retract after being pushed by the cam lobe 26.

The piston 22 is in contact with the fuel reservoir 16, allowing the piston 22 to exert a force which transmits work to the fuel in the fuel reservoir 16. The fuel reservoir 16 is adjacent to the piston 22 such that the piston 22 can be received into the fuel reservoir to do work on the fuel contained in the fuel reservoir 16. This work is in the form of compression and displacement of the fuel.

The fuel reservoir 16 has an inlet I and an outlet O. Metering devices may be added in proximity to the fuel reservoir 16 to control volumetric flow of fuel through the fuel reservoir 16. The outlet O has a high pressure check valve 28, such that when the fuel in the fuel reservoir 16 is compressed to a predetermined pressure, the fuel is permitted to flow through the outlet O. The inlet I is metered by an electromagnetic control valve 32 and leads to a low pressure source (not shown). The electromagnetic control valve 32 is operated by a solenoid 30. The electromagnetic control valve 32 shuts off the inlet I from its low pressure source. The two valves 28 and 32 function together to enable the fuel in the fuel reservoir 16 to be isolated from the low pressure source at the inlet I. The fuel may be compressed by the translation of the piston up to the release pressure of the check valve 28 at the outlet O, at which time the fuel is allowed to flow from the outlet O.

In operation, the fuel flows into the fuel reservoir 16 via the inlet I, due to the pressure differential between the low pressure source at the inlet I and the fuel reservoir 16. This low pressure source is typically supplied by a low pressure electric gasoline pump, such as those seen in port fuel injection automobile application.

The translation and force acting on the piston 22 transmits work to the fuel in the fuel reservoir 16. The fuel is displaced and compressed to the release pressure of the check valve 28 at the outlet O, at which point the fuel is allowed to flow out the outlet O. In the preferred embodiment, the outlet O leads to a fuel rail (not shown) which supplies direct injection injectors with high pressure fuel.

Once the fuel leaves the fuel reservoir 16, the spring 24, which is seated around the piston 22, pushes the piston 22 to its fully extended position. Simultaneously with the spring 24 returning the piston 22 to its fully retracted position, the electromagnetic control valve 32 is opened, allowing the fuel reservoir 16 to be filled once again by fuel from the low pressure source through the inlet I. The fuel is allowed to naturally flow or migrate by the piston 22 at a relatively low rate which is based on the clearance of the piston 22 and the bore 20. The migrating fuel will then find itself contained within the bellows 12 which may distend to accommodate the migrating fuel.

A check valve 33 is contained within the pump body 18, connected to the fuel reservoir 16 and the bellows 12. The check valve 33 allows any fuel contained in the fuel reservoir 16 that migrates past the piston 22, due to the large pressure differential, to flow in a unidirectional manner from the bellows 12 back to the fuel reservoir 16 on the opposite side of the piston 22 as the bellows contracts.

The bellows 12 is a stretchable membrane and has some degree of compliance to distend or expand and contract; thus as the migrating fuel is introduced into the bellows, it raises the pressure in the bellows 12 and the bellows may expand. This pressure is able to open the check valve 33, which is a bypass between the fuel reservoir 16 in the pump body 18 and the bellows 12, at which point the fuel is returned to the fuel reservoir 16 through the bypass.

Second Embodiment

Figure 2:
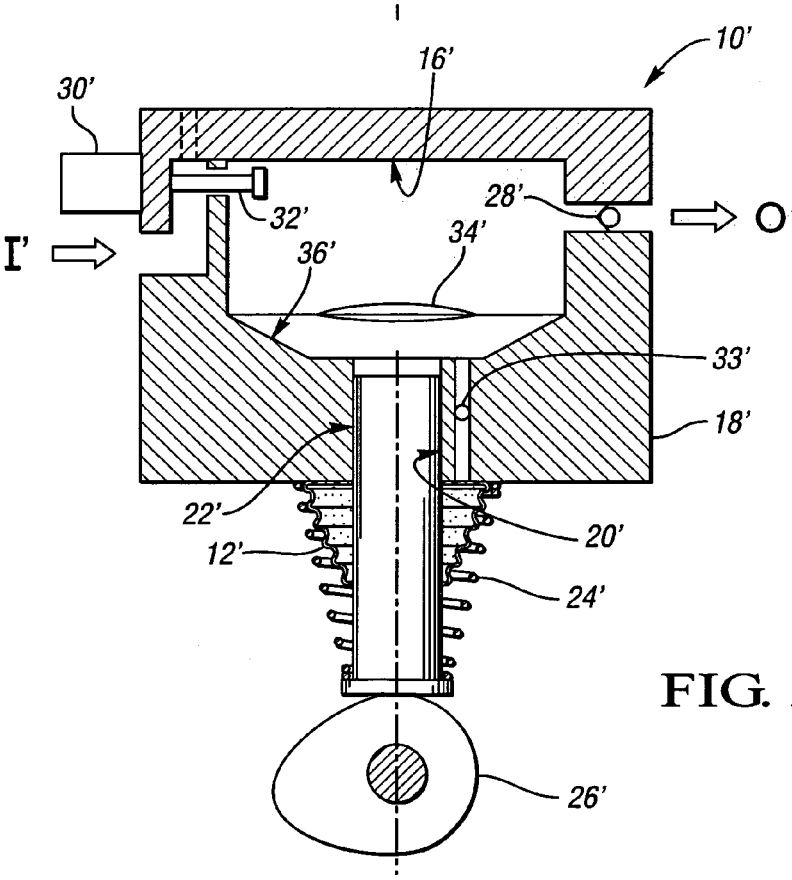
FIG. 2 is a schematic cross sectional view of a statically sealed piston-type high pressure fuel pump, illustrating the second embodiment of the invention.

Referring to FIG. 2, a statically sealed fuel pump 10', illustrating the second embodiment of the invention, is shown. In a second embodiment of the invention, a diaphragm seal 34' is placed inside the pump body 18', in addition to the bellows 12' and the other components of the first embodiment described above. A working fluid reservoir 36' is added adjacent to the diaphragm seal 34'. The diaphragm seal 34' is a static seal that separates the working fluid reservoir 36' and a fuel reservoir 16'. The diaphragm seal 34' at least partially defines the fuel reservoir 16' and the working fluid reservoir 36' is at least partially defined by the diaphragm seal 34'.

The working fluid reservoir 36' is capable of holding a working fluid. The working fluid may be a silicone based oil or other material suitable for this application. The working fluid may be engine oil. Ideally the working fluid has a high bulk modulus so as not to be compressible, and is stable i.e., it has minimal viscosity change from the maximum and minimum operating temperature of the fuel pump 10'.

The fuel pump 10' further comprises a reciprocating-type structure such as a movable piston 22'. The piston 22' is adjacent to the bellows 12' and translatable within the pump body 18'. The piston 22' is riding in a bore 20', a hollow structure one end of which is in contact with the working fluid reservoir 36', allowing the piston 22' to exert a force on the working fluid within the working fluid reservoir 36' and thereby transmit work to the fuel in the fuel reservoir 16' via the diaphragm seal 34'.

On the side of the bore 20' which is opposite to the working fluid reservoir 36' is the bellows 12', which is sealed to both the pump body 18' and the piston 22'. This creates a statically sealed area between the pump body 18', the diaphragm seal 34' and the bellows 12', in which the piston 22' is allowed to move translationally. The piston 22' is translationally movable due to either direct or indirect contact with a cam lobe 26'. The cam lobe 26' applies force on the piston 22' either directly or indirectly, as in the first embodiment described above.

Through a series of actions, the piston 22' transmits work to the fuel in the fuel reservoir 16'. The piston 22' is in contact with the working fluid reservoir 36' and transmits work to the working fluid within the working fluid reservoir 36', by compressing and displacing the working fluid. The working fluid within the working fluid reservoir 36', in turn, transmits work to the diaphragm seal 34'. The diaphragm seal 34', in turn, transmits work to the fuel in the fuel reservoir 16'.

The diaphragm seal 34' is impervious to debris and prevents debris from entering the piston 22' and bore 20'. A conventional dynamic seal may lead to leakage of fuel over several cycles. The addition of static seals such as the diaphragm seal 34' and bellows 12' allows for the use of a separate working fluid while minimizing leakage of the working fluid into the fuel and other parts of the engine (not shown). The diaphragm seal 34' may be constructed of an elastomer, stainless steel, rubber or other suitable materials that have sufficient elasticity and may be corrugated to provide compliance in the material.

The operation of the fuel pump 10' in the second embodiment is similar to the first embodiment. The fuel reservoir 16' has an inlet I' and an outlet O'. The outlet O' has a high pressure check valve 28', such that when the fuel in the fuel reservoir 16' is compressed to a predetermined pressure, the fuel is permitted to flow through the outlet O'. The inlet I' is metered by an electromagnetic control valve 32' and leads to a low pressure source (not shown). The electromagnetic control valve 32' is operated by a solenoid 30'. The electromagnetic control valve 32' shuts off the inlet I' from its low pressure source. The two valves 28' and 32' function together to enable the fuel in the fuel reservoir 16' to be isolated from the low pressure source at the inlet I'. The fuel may be compressed to the release pressure of the check valve 28' at the outlet O', at which time the fuel is allowed to flow from the outlet O'.

In operation, the fuel flows due to the pressure of the low pressure source at the inlet I', into the fuel reservoir 16' via the inlet I'. This low pressure source is typically supplied by a low pressure electric gasoline pump (not shown), such as those seen in port fuel injection automobile application.

The translation and force acting on the piston 22' transmits work through the working fluid to the diaphragm seal 34', which then acts to compress the fuel in the fuel reservoir 16'. The fuel is compressed to the release pressure of the check valve 28' at the outlet O', at which point the fuel is allowed to flow out the outlet O'. In the preferred embodiment, the outlet O' leads to a fuel rail (not shown) which supplies direct injection injectors with high pressure fuel.

Once the fuel leaves the fuel reservoir 16', a spring 24', which is biasingly seated around the piston 22', pushes the piston 22' to its fully retracted position. Simultaneously to the spring 24' returning the piston 22' to its fully retracted position, the electromagnetic control valve 32' is opened, allowing the fuel reservoir 16' to be filled once again by fuel from the low pressure source through the inlet I'. The working fluid is allowed to naturally flow or migrate by the piston 22' at a relatively low rate which is based on the clearance of the piston 22' and the bore 20'. The migrating working fluid will then find itself contained within the bellows 12' which may distend to accommodate the migrating fuel.

A check valve 33' is contained within the pump body 18', connected to the working fluid reservoir 36' and the bellows 12'. The check valve 33' allows any working fluid contained in the working fluid reservoir 36' that migrates past the piston 22, due to the large pressure differential, to flow in a unidirectional manner from the bellows 12' back to the working fluid reservoir 36' on the opposite side of the piston 22' as the bellows contracts.

The bellows 12' is a stretchable membrane and has some degree of compliance; thus as the migrating working fluid is introduced, it raises the pressure in the bellows 12' which may distend. This pressure is able to open the check valve 33', which is between the working fluid reservoir 36' in the pump body 18' and the bellows 12', at which point the working fluid is returned to the working fluid reservoir 36' as the bellows 12' contracts. The return of the "migrated" fluid to the working fluid reservoir 36' can only take place during the return stroke of the pump when the pressure of the working fluid is lowest. The bellows 12' must then be able to withstand at least the pressure of the low pressure supply.

The advantage of the second embodiment of the invention is that the statically sealed fuel pump 10' has two static seals, the bellows 12' and the diaphragm seal 34'. This configuration not only enables a working fluid to be contained in the working fluid reservoir 36', it allows for the use of a more suitable working fluid than gasoline or engine oil for lubrication, efficiency and fluid migration. Use of a more suitable working fluids allows for a less expensive pump because the tolerancing on the interface between the piston 22' and bore 20' does not need to be as precise. Moreover, completely sealing the fuel pump 10' makes it easier to integrate into an application because the pump 10' does not need to have an interface with an alternate working fluid, such as engine oil.

Both embodiments of the present invention do not have orientation restrictions because the aeration of engine oil is no longer an issue. In conventional pumps, engine oil is provided to fill the lower pump chamber. Since engine oil pressure is not always available on start-up, and because engine oil is typically aerated, there must be a method of deaerating the lower or working fluid pump chamber. This has been accomplished by mounting the pump below the camshaft centerline, which forces the lower density air to float toward the non-sealed piston and deaerate back into the crank case. In the case of a statically sealed pump, there is no opportunity for leakage, but also no opportunity for aeration if the pump is filled and primed at the manufacturing facility. Therefore, the orientation of the statically sealed fuel pump is not critical for deaeration.

While the best modes for carrying out the invention have been described in detail, those familiar with the art to which this invention relates will recognize various alternative designs and embodiments for practicing the invention within the scope of the appended claims.

The invention claimed is:

1. A statically-sealed fuel pump comprising:

a pump body;

a fuel reservoir within said pump body, wherein said fuel reservoir is capable of holding fuel;

a bellows attached to said pump body, wherein said bellows is a stretchable membrane sufficiently in a sealing relationship with said pump body to act as a static seal;

a movable piston adjacent to said bellows and translatable within said pump body, wherein said piston is in contact with said fuel reservoir and transmits work to said fuel within said fuel reservoir; and a check valve contained within said pump body and connected to said fuel reservoir and to said bellows;

wherein said bellows is sufficiently in a sealing relationship with said piston to act as a static seal; and wherein said check valve permits any fuel in said fuel reservoir that migrates past said piston to flow in a unidirectional manner from said bellows back into said fuel reservoir as the bellows contracts.

2. The fuel pump of claim 1, wherein said fuel pump is a direct injection, high pressure fuel pump.

3. The fuel pump of claim 1, wherein said fuel reservoir has an inlet and an outlet;

wherein said inlet leads to a low pressure source of fuel, wherein fuel from said low pressure source flows into said fuel reservoir at said inlet;

further comprising:

a metering device in proximity to said fuel reservoir, to control volumetric flow of said fuel through said fuel reservoir.

4. The fuel pump of claim 1, wherein said fuel reservoir has an inlet and an outlet;

wherein said inlet leads to a low pressure source of fuel, wherein fuel from said low pressure source flows into said fuel reservoir at said inlet;

further comprising:

an outlet check valve at said outlet, wherein said outlet check valve permits fuel in said fuel reservoir to flow through said outlet when said fuel in said fuel reservoir is compressed to a predetermined piston position.

5. The fuel pump of claim 1, wherein said fuel reservoir has an inlet and an outlet;

wherein said inlet leads to a low pressure source of fuel, wherein fuel from said low pressure source flows into said fuel reservoir at said inlet;

further comprising:

an electromagnetic control valve at said inlet, wherein said electromagnetic control valve shuts off said inlet from said low pressure source when said fuel in said fuel reservoir is compressed to a predetermined piston position.

6. The fuel pump of claim 1, further comprising:

a bore through which said piston translates; and a spring biasing said piston.

7. A statically-sealed fuel pump comprising:

a pump body;

a fuel reservoir within said pump body, wherein said fuel reservoir is capable of holding fuel;

a bellows attached to said pump body, wherein said bellows is a stretchable membrane sufficiently in a sealing relationship with said pump body to act as a static seal;

a diaphragm seal at least partially defining said fuel reservoir;

a working fluid reservoir at least partially defined by said diaphragm seal, wherein said working fluid reservoir is capable of holding a working fluid; and wherein said diaphragm seal is a static seal separating said working fluid reservoir and said fuel reservoir;

a movable piston adjacent to said bellows and translatable within said pump body;

wherein said piston is in contact with said working fluid reservoir and transmits work to fluid within said working fluid reservoir;

wherein said fluid within said working fluid reservoir further transmits work to said diaphragm seal;

wherein said diaphragm seal further transmits work to said fuel in said fuel reservoir; and wherein said bellows is statically sealed to said pump body and said piston;

a check valve contained within said pump body and connected to said working fluid reservoir and said bellows; and wherein said check valve permits any working fluid in said working fluid reservoir that migrates past said piston, to flow in a unidirectional manner from said bellows back into said working fluid reservoir.

8. The fuel pump of claim 7, wherein said fuel pump is a direct injection, high pressure fuel pump.

9. The fuel pump of claim 7, wherein said fuel reservoir has an inlet and an outlet;

wherein said inlet leads to a low pressure source of fuel, wherein fuel from said low pressure source flows into said fuel reservoir at said inlet;

further comprising:

a metering device in proximity to said fuel reservoir, to control volumetric flow of said fuel through said fuel reservoir.

10. The fuel pump of claim 7, wherein said fuel reservoir has an inlet and an outlet;

wherein said inlet leads to a low pressure source of fuel, wherein fuel from said low pressure source flows into said fuel reservoir at said inlet;

further comprising:

an outlet check valve at said outlet, wherein said outlet check valve permits fuel in said fuel reservoir to flow through said outlet when said fuel in said fuel reservoir is compressed to a predetermined piston position.

11. The fuel pump of claim 7, wherein said fuel reservoir has an inlet and an outlet;

wherein said inlet leads to a low pressure source of fuel, wherein fuel from said low pressure source flows into said fuel reservoir at said inlet;

further comprising:

an electromagnetic control valve at said inlet, wherein said electromagnetic control valve shuts off said inlet from said low pressure source when said fuel in said fuel reservoir is compressed to a predetermined piston position.

12. The fuel pump of claim 7, further comprising:

a bore through which said piston translates; and a spring biasing said piston.

13. A method of statically sealing a fuel pump, the method comprising:

providing a fuel pump, wherein said fuel pump has a pump body;

forming a fuel reservoir within said pump body, wherein said fuel reservoir is capable of holding fuel and having an opening for migrating fuel; and attaching a bellows to said pump body in communication with said opening, wherein said bellows is a stretchable membrane acting as a static seal;

adding a movable piston in the opening of said pump body; wherein said piston is in sufficient contact with said fuel reservoir to transmit work to fuel within said fuel reservoir;

using said bellows to statically seal said pump body and said piston, wherein said bellows contains said migrating fuel;

adding a check valve within said pump body and connecting said check valve to said fuel reservoir and to said bellows;

sealing said bellows relative to said piston sufficiently to act as a static seal; and facilitating any fuel in said fuel reservoir that migrates past said piston to flow in a unidirectional manner from said bellows back into said fuel reservoir via said check valve as the bellows contracts.

14. The method of claim 13, further comprising:

attaching a diaphragm seal inside said pump body in a manner to at least partially form said fuel reservoir;

adding a working fluid reservoir adjacent to said diaphragm seal, wherein said working fluid reservoir is capable of holding a working fluid;

wherein said piston is in contact with said working fluid reservoir and transmits work to fluid within said working fluid reservoir;

wherein said fluid within said working fluid reservoir further transmits work to said diaphragm seal;

wherein said diaphragm seal further transmits work to said fuel in said fuel reservoir; and wherein said diaphragm seal is a static seal separating said working fluid and said fuel in their respective reservoirs.

* * * * *